US009237401B2

(12) United States Patent
Modi et al.

(10) Patent No.: US 9,237,401 B2
(45) Date of Patent: Jan. 12, 2016

(54) ELECTRONIC DEVICES WITH ADJUSTABLE BIAS IMPEDANCES AND ADJUSTABLE BIAS VOLTAGES FOR ACCESSORIES

(75) Inventors: Yash Modi, Cupertino, CA (US); Brian Sander, San Jose, CA (US); Jeffrey J. Terlizzi, San Francisco, CA (US); Jahan Minoo, San Jose, CA (US); Wendell B. Sander, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 594 days.

(21) Appl. No.: 13/153,313

(22) Filed: Jun. 3, 2011

(65) Prior Publication Data

US 2012/0051554 A1 Mar. 1, 2012

Related U.S. Application Data

(60) Provisional application No. 61/378,897, filed on Aug. 31, 2010.

(51) Int. Cl.

| | |
|---|---|
| ***H04R 1/10*** | (2006.01) |
| ***H02B 1/00*** | (2006.01) |
| ***H04R 5/04*** | (2006.01) |
| ***H04R 3/00*** | (2006.01) |

(52) U.S. Cl.
CPC ... *H04R 5/04* (2013.01); *H04R 3/00* (2013.01)

(58) Field of Classification Search
CPC ..... H04R 3/00; H04R 19/04; H04R 5/04; H04H 60/04
USPC ..... 381/74, 91, 122, 123, 111, 113
See application file for complete search history.

(56) References Cited

U.S. PATENT DOCUMENTS

| | | | | |
|---|---|---|---|---|
| 5,532,649 | A * | 7/1996 | Sahyoun | 330/297 |
| 5,545,494 | A | 8/1996 | Trumble et al. | |
| 7,189,108 | B2 | 3/2007 | Takaya et al. | |
| 7,769,187 | B1 * | 8/2010 | Farrar et al. | 381/74 |
| 8,139,791 | B1 * | 3/2012 | Toosky | H03F 1/305 381/120 |
| 8,588,433 | B2 * | 11/2013 | Saulespurens | H04R 3/00 330/126 |
| 2005/0205281 | A1 | 9/2005 | Bachinski et al. | |
| 2005/0255724 | A1 | 11/2005 | Picco et al. | |

(Continued)

FOREIGN PATENT DOCUMENTS

| | | |
|---|---|---|
| KR | 10200600934331 | 8/2006 |
| WO | 2009/019801 | 2/2009 |

OTHER PUBLICATIONS

SmartLearner, Electricity Question, 2009, p. 14.*

*Primary Examiner* — Vivian Chin
*Assistant Examiner* — William A Jerez Lora
(74) *Attorney, Agent, or Firm* — Treyz Law Group, P.C.; Michael H. Lyons

(57) ABSTRACT

Electronic devices may provide microphone bias voltages to accessories. The accessories may include circuitry powered from the microphone bias voltages. The output impedances and the voltages of the microphone bias voltages may be adjusted during operation of the electronic devices. An electronic device may provide a bias voltage to an accessory, may lower the output impedance of the bias voltage, and may increase the voltage of the bias voltage during operation of the electronic device. Accessories that received bias voltages with lowered impedances or raised voltage levels may exhibit greater tolerance to faults such as moisture-based shorts and may be able to continue operating even in the presence of some faults.

19 Claims, 5 Drawing Sheets

(56) References Cited

U.S. PATENT DOCUMENTS

2006/0223581 A1* 10/2006 Jacobs et al. ..... 455/557
2007/0139842 A1 6/2007 De Longhi
2008/0044004 A1 2/2008 Keehr
2009/0121778 A1 5/2009 Ceballos et al.
2009/0180643 A1* 7/2009 Sander ..... H04M 1/05 381/111
2009/0296952 A1 12/2009 Pantfoerder et al.
2010/0315752 A1 12/2010 Rabu et al.
2011/0104940 A1 5/2011 Rabu et al.
2011/0228954 A1* 9/2011 Saulespurens et al. ..... 381/113

* cited by examiner

ELECTRONIC DEVICES WITH ADJUSTABLE BIAS IMPEDANCES AND ADJUSTABLE BIAS VOLTAGES FOR ACCESSORIES

This application claims the benefit of provisional patent application No. 61/378,897, filed Aug. 31, 2010, which is hereby incorporated by reference herein in its entirety.

BACKGROUND

This relates to electronic devices, such as electronic devices that provide bias signals to accessories using an audio jack.

Electronic devices such as cellular telephones, computers, music players, and other devices often contain audio jacks. Accessories such as headsets have mating plugs. A user who desires to use a headset with an electronic device may connect the headset plug into the mating audio jack on the electronic device.

It is often necessary to convey stereo audio signals, microphone signals, and button signals between an electronic devices and a headset connected to the electronic device. In a typical microphone-enabled headset, a bias voltage is applied to the microphone from the electronic device over the microphone line. The microphone in the headset generates a microphone signal when sound is received from the user (i.e., when a user speaks during a telephone call). Microphone amplifier circuitry and analog-to-digital converter circuitry in the cellular telephone can convert microphone signals from the headset into digital signals for subsequent processing.

To convey button signals (e.g., to accommodate additional functionality), some modern microphone-enabled headsets feature a button that, when pressed, shorts the microphone line to ground. Some other headsets also include ultrasonic tone generators that can be used to convey button signals using ultrasonic tones. In these types of arrangements, a headset includes an ultrasonic tone generator that generates ultrasonic tones on the microphone line. The ultrasonic tone generator is typically powered using the bias voltage on the microphone line. Monitoring circuitry in an electronic device to which the headset is connected can detect the momentary grounding of the microphone line and the ultrasonic tones on the microphone line.

Modern headsets typically require that the bias voltage have a sufficient magnitude for proper operation of the headsets. All headsets are, however, susceptible to wear, environmental effects, and other factors that can negatively impact the magnitude of the bias voltage available to circuitry within the headsets. For example, when a headset is drenched in moisture, as may occur when a user wears a headset while sweating, moisture-related shorts may develop in the headset that lower the magnitude of the bias voltage within the headset below a minimum voltage level that is necessary for the headset to operate properly.

It would therefore be desirable to provide electronic devices that provide adjustable bias impedances and adjustable bias voltages to accessories.

SUMMARY

Short tolerance in accessories may be increased by providing electronic devices with adjustable bias impedances and adjustable bias voltages. During some modes of operation, the impedance of a bias signal provided by an electronic device to an accessory may be decreased for certain types of accessories. The impedance of the bias signal may be lowered by connecting a resistor in series to an output impedance resistor using a control transistor. Alternatively or in addition to adjusting the impedance of the bias signal, the electronic device may increase the voltage of the bias signal provided to the accessory. When the impedance of the bias signal is lowered and when the voltage of the bias signal is raised, the fault tolerance of the accessory may be increased (e.g., the accessory may continue to operate properly even when moisture-based shorts or other shorts develop in the accessory).

Further features of the invention, its nature and various advantages will be more apparent from the accompanying drawings and the following detailed description of the preferred embodiments.

DETAILED DESCRIPTION

Figure 1:
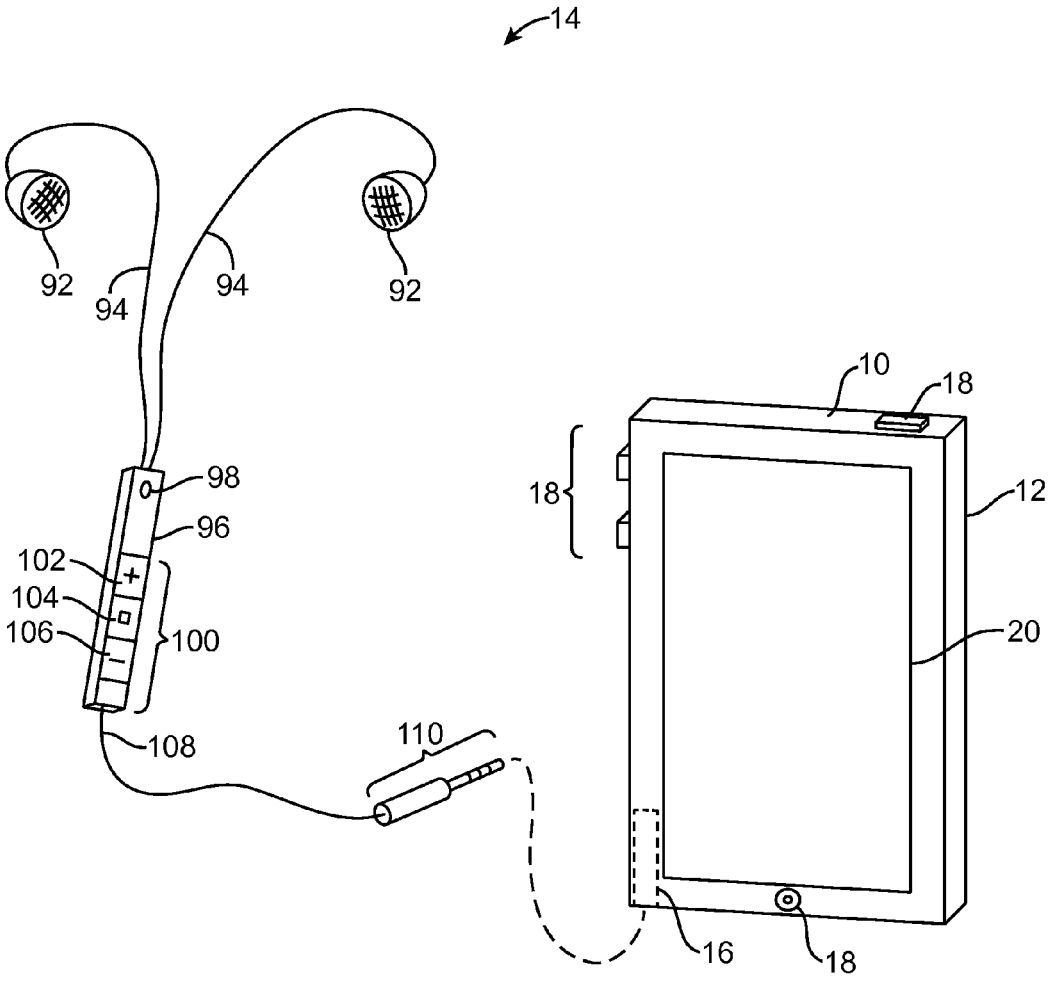
FIG. 1 is a perspective view of an illustrative accessory such as a headset and an illustrative electronic device such as a portable computer, media player, cellular telephone, or hybrid device showing how the handheld electronic device may have an audio connector that mates with the accessory and other external devices in accordance with an embodiment of the present invention.

An illustrative electronic device and an illustrative accessory are shown in FIG. 1. Electronic devices such as device 10 of FIG. 1 may be computers, handheld electronic devices such as cellular telephones and portable music players, portable devices such as tablet computers and laptop computers, gaming devices, and other electronic equipment. As shown in the example of FIG. 1, electronic device 10 may include a housing such as housing 12. Housing 12 may be formed from plastic, metal, fiber composites such as carbon fiber, glass, ceramic, other materials, and combinations of these materials. Housing 12 may be formed using a unibody construction in which housing 12 is formed from an integrated piece of material or may be formed from frame structures, housing walls, and other components that are attached to each other using fasteners, adhesive, and other attachment mechanisms.

A display such as display 20 may be mounted on the front face of device 10 (as an example). Display 20 may be a touch screen display. If desired, a track pad or other touch sensitive devices, a keyboard, a microphone, a speaker, and other user input-output devices may be used to gather user input and to supply the user with output. Ports such as port 16 may receive mating connectors (e.g., an audio plug, a connector associated with a data cable, etc.).

Buttons such as buttons 18 may be used to provide a user of device 10 with a way to supply device 10 with user input. A user may, for example, press a particular button (e.g., a menu button on the front face of device 10) to direct device 10 to display a menu of selectable on-screen options (e.g., icons) on display 20. A user may press other buttons to increase or decrease the volume of sound that is being played back to a user through a speaker in device 10 or through a pair of headphones attached to device 10 using port 16. If desired, buttons 18 may include a sleep/wake button (sometimes referred to as a sleep button or a power button) that can be pressed to alternately put device 10 into sleep and wake states or that can be held for a longer amount of time to place a device in a deep sleep mode. During sleep state operation, nonessential components may be turned off to conserve power. During wake state operation (sometimes referred to as active mode or normal operating mode), the circuitry of device 10 may be activated for use by a user.

Other buttons 18 that may be provided in device 10 include keypad keys, numeric pad keys, zoom keys, track pad keys, function keys, dedicated or semi-dedicated keys for launching an operating system function, application, or other software, fast forward, reverse, stop, pause, and other media playback keys, home buttons, buttons for controlling telephone calls (e.g., an answer call key, a hold key, a conference call key, etc.), slider switches, rocker switches, multi-position switches, help buttons, etc. In general, buttons 18 may be formed using any suitable mechanism that can open and close or otherwise alter a circuit. Examples where buttons 18 are implemented as momentary buttons using dome switches are sometimes described herein as an example. This is, however, merely illustrative.

Accessory 14 of FIG. 1 may be a headset with a microphone (as an example). Speakers 92 may be provided in the form of over-the-ear speakers, ear plugs, or ear buds (as examples). Dual-conductor wires such as wires 94 may be used to connect speakers 92 to user interface main unit 96. Unit 96 may include a microphone 98. In some applications, microphone 98 may not be needed and may therefore be omitted from accessory 14 to lower cost. In other applications, such as cellular telephone applications, voice recording applications, etc., microphone 98 may be used to gather audio signals (e.g., from the sound of a user's voice).

Unit 96 may include user input devices such as user input interface 100. In the FIG. 1 example, unit 96 includes three buttons. If desired, more buttons, fewer buttons, or non-button user input devices may be included in accessory 14. Moreover, it is not necessary for these devices to be mounted to the same unit as microphone 98. The FIG. 1 arrangement is merely illustrative. If desired, unit 96 may be connected within one of the branch paths 94, rather than at the junction between path 108 and paths 94. This may help position a microphone within unit 96 closer to the mouth of a user, so that voice signals can be captured accurately.

In an illustrative three-button arrangement, a first of the three buttons such as button 102 may be pressed by a user when it is desired to advance among tracks being played back by a music application or may be used to increase a volume setting. A second of the three buttons, such as button 104 may be pressed when it is desired to stop music playback, answer an incoming cellular telephone call made to device 10 from a remote caller, or when it is desired to make a menu selection. A third of the three buttons such as button 106 may be selected when it is desired to move to an earlier track or when it is desired to lower a volume setting. Multiple clicks, click and hold operations, and other user input patterns may also be used. The up/down volume, forward/reverse track, and "answer call" examples described in connection with FIG. 1 are merely illustrative. In general, the action that is taken in response to a given command may be adjusted by a system designer through modification of the software in device 10.

As shown in FIG. 1, a cable such as cable 108 may be integrated into accessory 14. At its far end, cable 108 may be provided with a connector such as audio connector 110. In the FIG. 1 example, accessory 14 has two speakers 92 and a microphone (microphone 98). Connector 110 may therefore be of the four-contact variety. In accessories in which microphone 98 or one of the speakers is omitted, signals can be carried over a three-contact connector. If desired, connectors with additional contacts may also be used (e.g., to carry auxiliary power, to carry control signals, etc.). Audio connectors with optical cores can be used to carry optical signals in addition to analog electrical signals. If desired, microphone 98 may be connected at a location along one of the wires leading to speakers 92, as this may help position microphone 98 adjacent to the mouth of a user.

Accessory 14 may be provided with circuitry that helps convey signals from user input interface 100 to device 10 through connector 110 and plug 16. In general, any suitable communications format may be used to convey signals (e.g., analog, digital, mixed arrangements based on both analog and digital formats, optical, electrical, etc.). To avoid the need to provide extra conductive lines and to ensure that accessory 14 is as compatible as possible with standard audio jacks, it may be advantageous to convey signals over existing lines (e.g., speaker, microphone, and ground). In particular, it may be advantageous to use the microphone and ground lines (e.g., the lines connected to contacts such as sleeve and ring contacts in connector 110) to convey signals such as user input signals and control signals between accessory 14 and electronic device 10.

With one suitable communications arrangement, buttons such as buttons 102, 104, and 106 may be encoded using different resistances. When a user presses a given button, device 10 can measure the resistance of user input interface 100 over the microphone and ground lines and can thereby determine which button was pressed. With another suitable arrangement, a button may be provided that shorts the microphone and ground wires in cable 108 together when pressed. Electronic device 10 can detect this type of momentary short. With yet another suitable arrangement, button presses within interface 100 may be converted to ultrasonic tones that are conveyed over the microphone and ground line. Electronic device 10 can detect and process the ultrasonic tones.

If desired, electronic device 10 can support communications using two or more of these approaches. Different approaches may be used, for example, to support both legacy hardware and new hardware, to support different types of software applications, to support reduced power operation in certain device operating modes, etc.

Ultrasonic tones lie above hearing range for human hearing (generally considered to be about 20,000 Hz). In a typical arrangement, the ultrasonic tones might fall within the range of 75 kHz to 300 kHz (as an example). Ultrasonic tones at frequencies of less than 75 kHz may be used, but may require more accurate circuitry to filter from normal microphone audio signals. Ultrasonic tones above 300 kHz may become susceptible to noise, because the conductors in many headset cables are not design to handle high-frequency signals. The cables can be provided with shielding and other structures that allow high speed signaling to be supported, or, more typically, lower tone frequencies may be used.

Ultrasonic tones may be formed using any suitable oscillating waveform such as a sine wave, saw (triangle) wave, square wave, etc. An advantage of saw and sine waves is that these waveforms contain a narrower range of harmonics than, for example, square waves. As a result, ultrasonic tones based on sine or saw waves may exhibit relatively narrow bandwidth. This may simplify detection and reduce the likelihood of audio interference.

Ultrasonic tones will not be audible to human hearing and therefore represent a form of out-of-band transmission. Arrangements that rely on ultrasonic tones in this way can avoid undesirable audible pops and clicks that might otherwise be associated with a button arrangement that momentarily shorts the microphone line and ground line together upon depression of a button and thereby momentarily Circuitry may be provided within accessory 14 (e.g., within main unit 96) to handle operations associated with communicating between accessory 14 and device 10. For example, circuitry may be provided in accessory 14 to transmit ultrasonic tones and to receive signals from device 10. If desired, this circuitry may be provided in an accessory that takes the form of an adapter.

Conventional electronic devices provide a bias voltage at a fixed impedance on a microphone line for accessories. The impedance provided by a conventional electronic device is typically relatively high (e.g., on the order of two thousand Ohms). An accessory connected to the electronic device uses the high-impedance bias voltage to power microphone circuitry and ultrasonic tone generator circuitry. However, moisture, wear, and other environmental effects can cause undesirable shorts to develop in the accessory between the microphone line and a ground line. These shorts reduce the voltage level (i.e., magnitude) of the bias voltage, because of the high-impedance nature of the bias voltage, and eventually render the accessory inoperable.

Figure 2:
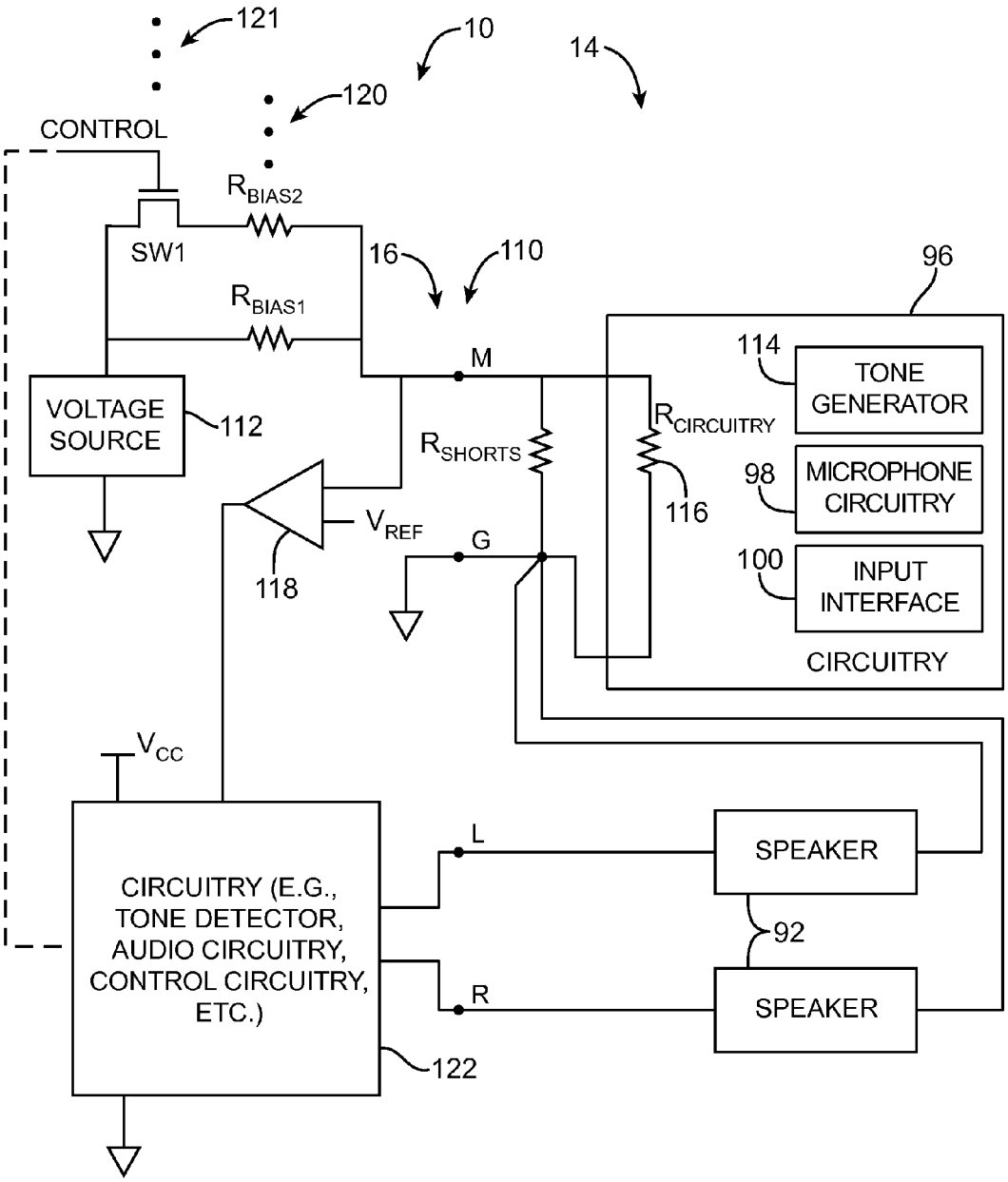
FIG. 2 is a schematic diagram of an illustrative accessory and an electronic device that may include adjustable bias circuitry in accordance with an embodiment of the present invention.

As shown in FIG. 2, electronic devices such as device 10 of FIG. 1 may include circuitry that adjusts output impedances of a bias voltage supplied to accessories. If desired, devices such as device 10 may include circuitry that adjusts voltages (i.e., magnitudes) of the bias voltage supplied to accessories in addition to or instead of adjusting output impedances of the bias voltage.

Device 10 may supply a bias voltage to accessory 14 over microphone line M. Voltage source 112 may generate a DC voltage. As one example, voltage source 112 may be a low-dropout (LDO) regulator that generates an output at approximately 2.7 volts. In general, other voltage supply circuits may be used to form voltage source 112 and voltage source 112 may generate an output at any voltage (and impedance).

Resistor $R_{BIAS1}$ may couple voltage source 112 to a microphone contact in connector 16 of device 10 and thereby provide a microphone bias signal to microphone line M. Circuitry in accessory 14 such as user interface main unit 96 of FIG. 1 may receive the microphone bias signal. As examples, unit 96 and circuitry in accessory 14 may use the microphone bias signal to bias one or more microphones and to power circuitry in accessory 14 such as tone generator 114, microphone circuitry 98, and input interface 100. The power load generated on the microphone line by circuitry 96 is shown schematically by resistor 116 ($R_{CIRCUITRY}$).

Microphone circuitry 98 and tone generator 114 in circuitry 96 of accessory 14 may transmit signals from accessory 14 to device 10 over microphone line M. As one example, device 10 may include an optional input circuit such as comparator 118 connected to microphone line M. When it is desired to transmit signals to device 10 using microphone circuitry 98 and tone generator 114, microphone circuitry 98 and/or tone generator 114 may generate currents on microphone line M. The currents on microphone line M are then converted to voltages by the impedance between microphone line M and voltage source 112 (e.g., resistors $R_{BIAS1}$, $R_{BIAS2}$, and any additional resistors 120 in device 10). Optional comparator circuit 118 then compares the voltages on microphone line M to a reference voltage $V_{REF}$ and converts the voltages into an input signal for circuitry 122 of device 10.

Circuitry 122 of device 10 may include tone detector circuitry, audio codec circuitry, microphone circuit, control circuitry, etc. Audio codec circuitry in circuitry 122 may output audio signals for speakers 92 on left channel audio line L and right channel audio line R. Microphone circuitry in circuitry 122 may receive microphone signals from microphone circuitry 98 over microphone line M and, if present, optional comparator 118. Tone detector circuitry in circuitry 122 may receive tone signals such as ultrasonic tones from tone generator 114 over microphone line and, if present, optional comparator 118. If desired, circuitry 122 may include monitoring circuitry that monitors the voltage level on microphone line M.

In general, accessories such as accessory 14 are designed to receive a microphone bias signal having a voltage that lies within a range of acceptable voltages. If the voltage of the microphone bias signal drops below the acceptable voltage range, accessory 14 will no longer operate properly (e.g., tone generator 114 may no longer operate, microphone circuitry 98 may no longer operate, etc.). One potential cause of lowered microphone bias signal voltages (which can render accessory 96 inoperable, if the effects of the shorts are not compensated for) are unintended shorts that can develop between microphone line M and ground line G in accessory 14. These shorts are shown schematically in FIG. 2 as resistor $R_{SHORTS}$. Possible causes of shorts between microphone line M and ground line G include moisture-based shorts (e.g., sweat-based shorts), dendritic growths, physical damage including wear from prolonged and/or repeated use of accessory 14, etc. When these unintended shorts are not present, $R_{SHORTS}$ has a relatively large value and does not affect the operation of accessory 14. However, when these unintended shorts are present, $R_{SHORTS}$ may have a small enough value to negatively affect the operation of accessory 14, if the effects of the shorts are not compensated for.

Device 10 may include additional circuits such as switch SW and resistor $R_{BIAS2}$ connected in parallel between voltage source 112 and microphone line M (e.g., connected across the terminals of resistor $R_{BIAS1}$). When switch SW is turned on by control signal CONTROL (which, if desired, may be generated by circuitry 122), resistor $R_{BIAS2}$ lowers the output impedance of the microphone bias signal. As an example, resistor $R_{BIAS1}$ may have a resistance of approximately 2.21 kilohms, resistor $R_{BIAS2}$ may have a resistance of approximately 1.0 kilohms, and the parallel network of resistors $R_{BIAS1}$ and $R_{BIAS2}$ (i.e., when switch SW1 is activated) may have a resistance of approximately 0.69 kilohms. The lowered output impedance of the microphone bias signal on microphone line M can ensure that the additional current generated by shorts in accessory 14 (i.e., resistors $R_{SHORTS}$) does not cause the voltage of the microphone bias signal to drop below acceptable levels, thereby ensuring proper operation of circuitry 96.

If desired, resistor $R_{BIAS2}$ may be a variable resistor and the resistance of resistor $R_{BIAS2}$ may be selected based on measured values of the voltage on microphone line M (e.g., circuitry 122 may determine if the voltage on line M has dropped below acceptable levels and, in response, lower the resistance of variable resistor $R_{BIAS2}$ while switch SW1 is active). In addition or alternatively, device 10 may include more than one switch and resistor circuits (illustrated as switches 121 and resistors 120) connected in parallel to the terminals of resistor $R_{BIAS1}$. With this type of arrangement, the switches may be selectively turned off and on to select a particular resistance for the resistor network between voltage source 112 and microphone line M. These are merely illustrative examples.

Figure 3:
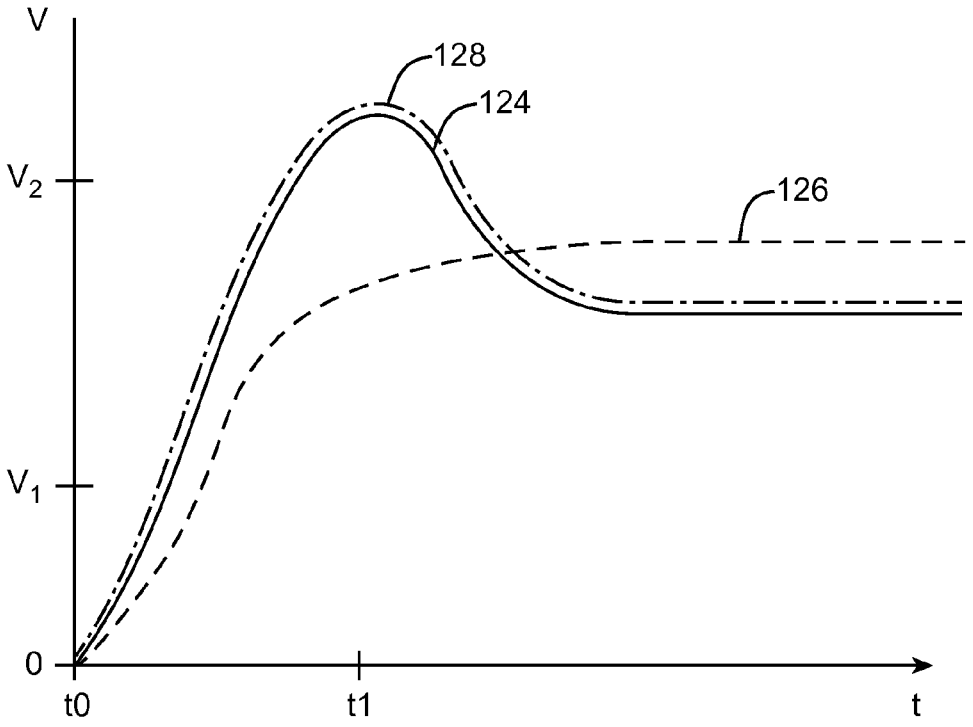
FIG. 3 is a graph of illustrative voltages on a communications path between an electronic device and an accessory of the type shown in FIG. 2 in accordance with an embodiment of the present invention.

As shown in FIG. 3, circuitry in accessory 14 such as circuitry 96 may undergo an initialization phase when accessory 14 is connected to device 10 (and after a button is pressed that momentarily shorts microphone line M to ground G). Curve 124 of the graph of FIG. 3 illustrates the voltage on microphone line M when the impedance between voltage source 112 and microphone line M is relatively high (e.g., when switch SW1 is turned off) and there are no shorts in accessory 14 (e.g., when the resistance of $R_{SHORTS}$ is relatively high). Curve 126 illustrates the voltage on microphone line M when the impedance between voltage source 112 and microphone line M is relatively high (e.g., when switch SW1 is turned off) and there are shorts in accessory (e.g., when the resistance of $R_{SHORTS}$ is relatively low). Curve 128 illustrates the voltage on microphone line M when the impedance between voltage source 112 and microphone line M is relatively low (e.g., when switch SW1 is turned on) and there are shorts in accessory 14 (e.g., when the resistance of $R_{SHORTS}$ is relatively low).

At time $t_0$, accessory 14 may be connected to device 10 or a momentary short between microphone line M and ground G may be severed. Following time $t_0$, the voltage on microphone line M may begin to rise from zero volts (e.g., as the voltage from voltage source 112 propagates through resistors $R_{BIAS1}$ $R_{BIAS2}$ etc.).

When the bias voltage on microphone line M rises above voltage $V_1$, circuitry in accessory 14 such as circuitry 96 turns on (e.g., circuitry 96 begins initialization). As one example, voltage $V_1$ may be approximately 0.9 volts.

When the bias voltage on microphone line M rises above voltage $V_2$, circuitry in accessory 14 may enter an active mode of operation. As one example, circuitry 96 may enter a tone mode in which button signals are conveyed from accessory 14 to device 10 using ultrasonic tones generated by tone generator 114 in response to button presses. After accessory 14 enters the tone mode, the current draw of circuitry 96 causes the voltage on microphone line M to drop to a lower voltage. Generally, circuitry 96 will continue to operate in the tone mode as long as the voltage on microphone line M remains above a threshold value (e.g., 1.5 volts).

As shown by curve 124 of FIG. 3, when the impedance between voltage source 112 and microphone line M is relatively high (e.g., when switch SW1 is turned off) and there are no shorts in accessory 14 (e.g., when the resistance of $R_{SHORTS}$ is relatively high), device 10 provides a microphone bias signal that reaches voltage $V_2$ at approximately time $t_1$. However, when shorts develop in accessory 14 between microphone line M and ground line G, the microphone bias signal may never reach voltage $V_2$ (as illustrated by curve 126) and accessory 14 may therefore never enter the active tone mode (e.g., accessory 14 may be rendered at least partially inoperable). By lowering the impedance of the microphone bias signal provided by device (i.e., by activating switch SW1), device 10 is able to ensure that the microphone bias signal reaches voltage $V_2$ (as illustrated by curve 128), even when shorts have developed in accessory 14 between microphone line M and ground line G.

Figure 4:
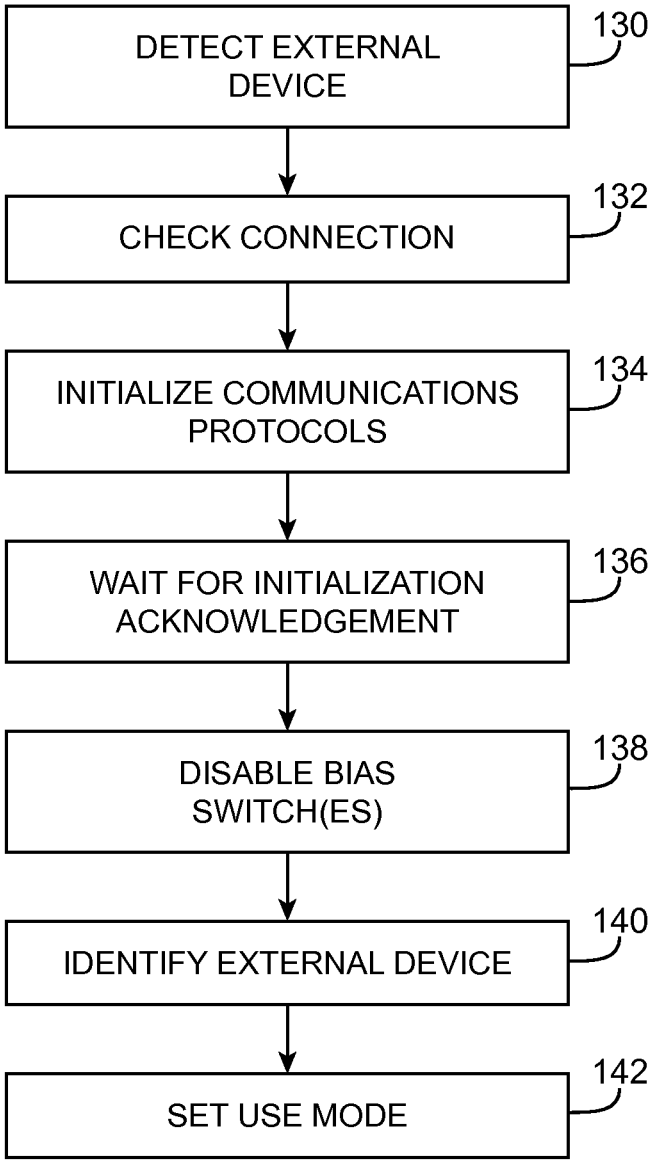
FIG. 4 is a flow chart of illustrative steps involved in initializing an external device such as a headset accessory in accordance with an embodiment of the present invention.

A flow chart of illustrative steps involved in initializing an external device such as accessory 14 that is connected to an electronic device 10 is shown in FIG. 4.

In step 130, an external device such as accessory 14 may be connected to device 10 and device 10 may detect the connection of the external device. Device 10 may, for example, include circuitry that monitors conductive contacts in plug 16 for signs that an external device such as accessory 14 has been connected to device 10 through plug 16. With one suitable arrangement, device 10 may activate switch SW1 of FIG. 2 prior to or when the external device is connected to device 10.

In step 132, device 10 may check the status of the connection to the external device (e.g., the connection between connectors 110 and 16). As one example, device 10 may check that the connector of the external device (e.g., connector 110) is fully inserted into plug 16 and that all of the conductive contacts of the connector of the external device are connected to the appropriate conductive contacts of plug 16.

In step 134, device 10 may initialize one or more communications protocols. If desired, device 10 may transmit one or more signals (e.g., by providing a specific bias voltage or impedance, by providing ultrasonic tones, etc.) to the external device requesting that the external device provide information on the communications protocols supported by the external device.

In step 136, device 10 may wait for acknowledgment from the external device of initialization of one or more communications protocols. As an example, device 10 may monitor microphone line M for acknowledgment signals or other signals identifying the external device (e.g., signals that identify what type of device is connected to device 10 and what communications protocols the external device supports).

In step 138, device 10 may disable bias switches such as switch SW1 and switches 121 of FIG. 2. If desired, bias switches such as switch SW1 and switches 121 may be disabled during the operations of steps 130, 132, 134, and 136 and step 138 may by bypassed (since the switches are already disabled).

In step 140, device 10 may identify the external device connected in step 130. For example, device 10 may determine if the external device is a legacy device that does not include circuitry 96, if the external device is a legacy device that does not include tone generator 114, or if the external device is a device such as accessory 14 that includes circuitry 96 and is capable of transmitting signals to device 10 using tone generator 114.

In step 142, device 10 may set a use mode. For example, device 10 may configure itself and the external device for audio playback, for microphone capture, for input functionality, etc.

Figure 5:
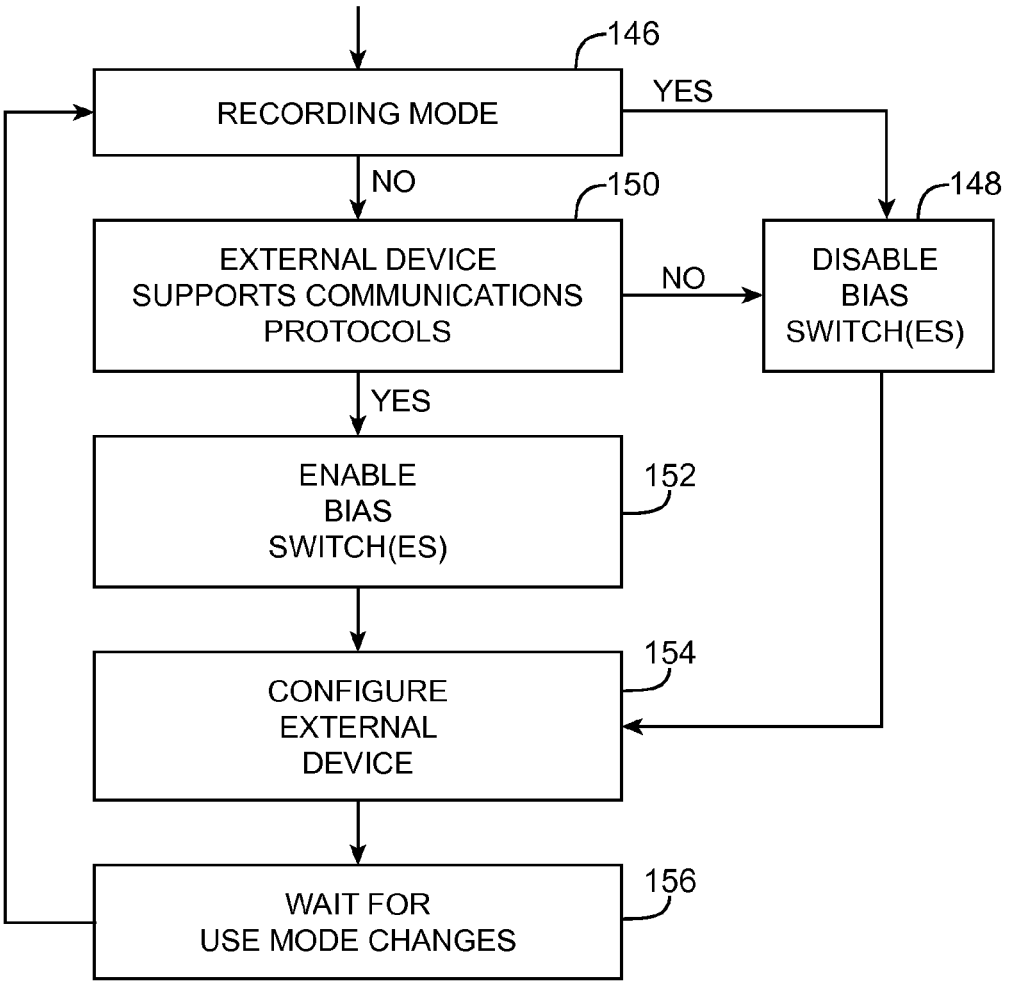
FIG. 5 is a flow chart of illustrative steps involved in configuring adjustable bias circuitry in an electronic device in accordance with an embodiment of the present invention.

A flow chart of illustrative steps involved determining whether to increase or decrease the output impedance of a microphone bias voltage is shown in FIG. 5. The operations of FIG. 5 may be performed as part of setting a user mode in step 142 of FIG. 4.

In step 146, device 10 may determine if an external device connected to device 10 such as accessory 14 is in a recording mode (e.g., whether a user's voice is being captured using a microphone on the external device). When a user's voice is being captured using a microphone on the external device, device 10 may increase the impedance of the microphone bias voltage by turning off bias switches such as switch SW1 and switches 121 in step 148. Device 10 may perform the operations of step 150 when a user's voice is not being captured using a microphone on the external device.

In step 150, device 10 may determine if the external device supports selected communications protocols (e.g., communications protocols utilizing ultrasonic tones). When the external device does not support the selected communications protocols (e.g., when the external device is a legacy device), device 10 may turn off bias switches such as switch SW1 and switches 121 in step 148. When the external device is a device such as accessory 14 that supports the selected communications protocols (e.g., when the external device includes ultrasonic tone communications circuitry), device 10 may decrease the impedance of the microphone bias voltage by turning on bias switches such as switch SW1 and switches 121 in step 152.

Following step 148 or step 152, device 10 may configure the external device in step 154. For example, device 10 may initialize communications with accessory 14 using ultrasonic tones in step 154.

In step 156, device 10 may wait for changes in the use of the external device. Device 10 may monitor signals being transmitted to and received from the external device and may monitor hardware and software in device 10 to determine when the usage of the external device changes. When the usage of the external device changes, device 10 may loop back to the operations of step 146. For example, when device 10 determines that the external device is supplying microphone signals (when the external device wasn't previously supplying microphone signals) or that the external device is no longer supply microphone signals, device 10 may loop back to the operations of step 146, so that bias switch SW1 is enabled or disabled according to the logic embodied in FIG. 5.

If desired, device 10 may implement a variety of schemes to increase fault tolerance in accessory 14. As described in connection with FIGS. 3, 4, and 5, device 10 may provide an bias voltage with an adjustable impedance and may decrease the impedance when possible (e.g., when not receiving microphone signals and when the external device is not a legacy device that may not support lowered bias impedances) to increase the tolerance of accessory 14 to internal shorts. Device 10 may, if desired, monitor the voltage on microphone line M and, if the voltage on line M falls below a threshold value, device 10 may enable one or more switches such as switch SW1 and switches 121 to decrease the impedance of the microphone bias signal.

If desired, voltage source 112 of device 10 may include an adjustable voltage source. With this type of arrangement, device 10 may monitor the voltage on microphone line M and, if the voltage on microphone line M is indicative of shorts occurring in accessory 14 (e.g., if the voltage on line M begins to take a form similar to curve 126 of FIG. 3, if the voltage on line M falls below a threshold value, etc.), device 10 may increase the voltage supplied by voltage source 112 to compensate. These and other schemes may be implemented alone or in combination with each other.

The foregoing is merely illustrative of the principles of this invention and various modifications can be made by those skilled in the art without departing from the scope and spirit of the invention.

What is claimed is:

1. An electronic device in first and second modes of operation, comprising:

audio codec circuitry;

an audio connector that connects to an accessory and that comprises a microphone terminal and a microphone line;

adjustable bias circuitry that generates an adjustable bias signal that is supplied to the accessory through the microphone line, wherein the adjustable bias circuitry provides the adjustable bias signal with a first impedance during the first mode in response to determining that microphone voice signals are being conveyed over the microphone line, and the adjustable bias circuitry provides the adjustable bias signal with a second impedance that is less than the first impedance during the second mode in response to determining that the microphone voice signals are not being conveyed over the microphone line, the adjustable bias circuitry comprising:

a voltage source;

a bias resistor connected between the voltage source and the microphone terminal; and comparator circuitry coupled between the microphone terminal and the audio codec circuitry, the comparator circuitry having an output terminal coupled to the audio codec circuitry, a first input terminal coupled to the microphone terminal, and a second input terminal coupled to a reference voltage.

2. The electronic device defined in claim 1 wherein, during the first mode of operation, the audio codec circuitry receives the microphone voice signals from the accessory through the microphone line in the audio connector.

3. The electronic device defined in claim 1 wherein the bias resistor comprises a first bias resistor, the adjustable bias circuitry further comprising:

a switch;

a second bias resistor-connected together in series with the switch between the voltage source and the microphone terminal; and circuitry that generates a first control signal that turns off the switch so that the second bias resistor is electrically isolated during the first mode of operation and a second control signal that turns on the switch so that the second bias resistor is electrically coupled between the voltage source and the microphone terminal during the second mode of operation.

4. A method comprising:

generating, in an electronic device, an adjustable bias signal;

supplying the adjustable bias signal to an external device through a microphone line in an audio connector in the electronic device; and determining whether the external device is conveying microphone signals to the electronic device over the microphone line, wherein generating the adjustable bias signal comprises:

when it is determined that the external device is conveying microphone voice signals to the electronic device over the microphone line, generating a first bias signal that has a first impedance; and when it is determined that the external device is not conveying microphone voice signals to the electronic device over the microphone line, generating a second bias signal that has a second impedance, wherein the first impedance is greater than the second impedance.

5. The method defined in claim 4 wherein generating the first bias signal comprises disabling at least one switch in the electronic device.

6. The method defined in claim 5 wherein generating the second bias signal comprises enabling the at least one switch in the electronic device.

7. The method defined in claim 4 further comprising determining whether the external device supports a given communications protocol over the microphone line.

8. The method defined in claim 4 further comprising:

determining whether the external device supports a given communications protocol over the microphone line, wherein generating the adjustable bias signal comprises:

when it is determined that the external device does not support the given communications protocol over the microphone line and when it is determined that the external device is not conveying microphone signals to the electronic device over the microphone line, generating the first bias signal; and when it is determined that the external device supports the given communications protocol over the microphone line and when it is determined that the external device is not conveying microphone signals to the electronic device over the microphone line, generating the second bias signal.

9. A method comprising:

generating, in an electronic device, an adjustable bias signal;

supplying the adjustable bias signal to an external device through a microphone line in an audio connector in the electronic device; and determining whether the external device supports a given communications protocol over the microphone line, wherein generating the adjustable bias signal comprises:

when it is determined that the external device does not support the given communications protocol over the microphone line, generating a first bias signal that has a first impedance;

when it is determined that the external device supports the given communications protocol over the microphone line, generating a second bias signal that has a second impedance, wherein the first impedance is greater than the second impedance;

with voltage monitoring circuitry on the electronic device, monitoring voltage on the microphone line to determine whether the voltage on the microphone line is less than a threshold value; and in response to determining that the voltage on the microphone line is less than the threshold value, increasing a magnitude of the first bias signal so that the voltage on the microphone line exceeds the threshold value.

10. The method defined in claim 9 wherein generating the first bias signal comprises disabling at least one switch in the electronic device.

11. The method defined in claim 10 wherein generating the second bias signal comprises enabling the at least one switch in the electronic device.

12. The method defined in claim 9 further comprising determining whether the external device is conveying microphone signals to the electronic device over the microphone line.

13. The method defined in claim 9 further comprising:

determining whether the external device is conveying microphone signals to the electronic device over the microphone line, wherein generating the adjustable bias signal comprises:

when it is determined that the external device is not conveying microphone signals to the electronic device over the microphone line and when it is determined that the external device does not support the given communications protocol over the microphone line, generating the first bias signal;

when it is determined that the external device is not conveying microphone signals to the electronic device over the microphone line and when it is determined that the external device supports the given communications protocol over the microphone line, generating the second bias signal; and when it is determined that the external device is conveying microphone signals to the electronic device over the microphone line, generating the first bias signal.

14. The electronic device defined in claim 1, further comprising:

audio codec circuitry; and comparator circuitry coupled between the microphone terminal and the audio codec circuitry.

15. The electronic device defined in claim 1, wherein the adjustable bias circuitry further comprises:

a switch, wherein the switch is coupled between the voltage source and the microphone terminal in series with the bias resistor.

16. The electronic device defined in claim 15, wherein the adjustable bias circuitry further comprises:

additional bias resistors, wherein the additional bias resistors are connected between the voltage source and the microphone terminal in parallel with the bias resistor.

17. The electronic device defined in claim 16, further comprising:

additional switches coupled between the voltage source and the microphone terminal.

18. The method defined in claim 4, wherein the first impedance is selected such that the first bias signal has a magnitude that exceeds a magnitude threshold, the method further comprising:

when the magnitude of the first bias signal exceeds an additional threshold that is less than the magnitude threshold, turning on the external device; and when the magnitude of the first bias signal exceeds the magnitude threshold, entering an active mode of operation at the external device.

19. The method defined in claim 9, further comprising:

when the magnitude of the first bias signal is at the level that is greater than the threshold value, entering an active mode of operation at the external device.

* * * * *